US010758773B2

(12) United States Patent
Clark

(10) Patent No.: US 10,758,773 B2
(45) Date of Patent: Sep. 1, 2020

(54) ABDOMINAL EXERCISE MAT

(71) Applicant: Coulter Ventures, LLC, Columbus, OH (US)

(72) Inventor: Bonnie Elizabeth Clark, Canton, GA (US)

(73) Assignee: Coulter Ventures, LLC, Columbus, OH (US)

( * ) Notice: Subject to any disclaimer, the term of this patent is extended or adjusted under 35 U.S.C. 154(b) by 0 days.

(21) Appl. No.: 15/265,180

(22) Filed: Sep. 14, 2016

(65) Prior Publication Data

US 2018/0071567 A1 Mar. 15, 2018

(51) Int. Cl.

| | |
|---|---|
| ***A63B 21/00*** | (2006.01) |
| ***A63B 23/02*** | (2006.01) |
| ***A63B 71/00*** | (2006.01) |
| ***A47G 27/02*** | (2006.01) |
| ***A63B 6/00*** | (2006.01) |

(52) U.S. Cl.

CPC ..... *A63B 21/4037* (2015.10); *A47G 27/0212* (2013.01); *A63B 6/00* (2013.01); *A63B 21/00047* (2013.01); *A63B 21/4039* (2015.10); *A63B 23/02* (2013.01); *A63B 23/0205* (2013.01); *A63B 23/0211* (2013.01); *A63B 23/0216* (2013.01); *A63B 23/0222* (2013.01); *A63B 71/0054* (2013.01); *A63B 2209/00* (2013.01)

(58) Field of Classification Search

CPC ..... A63B 23/4037; A63B 23/4039; A63B 71/0054; A63B 23/00; A63B 23/02; A63B 23/0205; A63B 23/0211; A63B 23/0222; A63B 23/0227; A63B 2209/00; A63B 6/00; A63B 21/4037; A63B 21/4039; A63B 21/00047; A47G 27/0212; A47G 27/0237; A47G 9/1063; A47G 9/1072; A47C 20/021; A47C 20/025

See application file for complete search history.

(56) References Cited

U.S. PATENT DOCUMENTS

| | | | | | |
|---|---|---|---|---|---|
| 1,904,039 | A * | 4/1933 | Bruder | A61H 7/001 | 482/142 |
| 2,795,802 | A * | 6/1957 | Myers | A47G 9/10 | 5/632 |
| 3,965,507 | A * | 6/1976 | Reiland | A63B 6/02 | 482/18 |
| 4,189,182 | A * | 2/1980 | Rhoe | A47C 7/425 | 297/452.32 |
| 4,210,322 | A * | 7/1980 | Pritchard | A63B 21/00047 | 446/216 |

(Continued)

*Primary Examiner* — David R Hare

(74) *Attorney, Agent, or Firm* — The Watson IP Group, PLC; Jovan N. Jovanovic

(57) ABSTRACT

An abdominal exercise mat having and upper portion and a leg portion. The upper portion having a base surface and an upper surface. The upper surface having an outwardly concave configuration defined by an upwardly inclined upper end section and an upwardly inclined lower end section. The leg portion extends away from the bottom end of the upper portion, and includes a first side leg and a second side leg. The first and second side legs define a channel therebetween, wherein the distal ends of each of the first side leg and the second side leg are configured to move independently of each other.

21 Claims, 8 Drawing Sheets

(56) References Cited

U.S. PATENT DOCUMENTS 4,245,838 A * 1/1981 Gordon ..... A63B 6/02 482/15
D267,028 S * 11/1982 Spisak ..... A63B 23/03575 D21/686
4,726,085 A * 2/1988 Antonio ..... A47D 15/00 2/49.4
4,987,625 A * 1/1991 Edelson ..... A47C 20/026 5/420
5,026,315 A * 6/1991 Chap ..... A63H 3/02 446/369
5,103,516 A * 4/1992 Stevens ..... A47C 20/021 5/632
5,266,378 A * 11/1993 Stephenson ..... B60T 3/00 188/32
5,431,618 A * 7/1995 Levi ..... A63B 21/00047 482/142
5,457,832 A * 10/1995 Tatum ..... A61F 5/01 5/636
5,458,549 A * 10/1995 Obery ..... A63B 21/4037 482/140
5,575,028 A * 11/1996 Brau ..... A47G 9/1045 446/296
5,611,765 A * 3/1997 Koch, Jr. ..... A63B 23/03575 482/140
5,647,829 A * 7/1997 Rivas ..... A63B 23/0211 482/140
5,978,990 A * 11/1999 Akey ..... A47C 20/021 5/631
6,110,083 A * 8/2000 Riser ..... A63B 21/154 482/142
6,230,348 B1 * 5/2001 Patrikakis ..... A47C 7/383 5/636
7,207,932 B1 * 4/2007 Dean ..... A63B 23/0211 482/140
D599,151 S * 9/2009 Wilson ..... A63B 21/4037 D6/601
7,648,449 B1 * 1/2010 Detert ..... A47C 27/081 441/129
7,665,165 B2 * 2/2010 Maganov ..... A63B 21/4037 128/845
9,220,359 B2 * 12/2015 Long ..... A47G 9/06
9,539,457 B2 * 1/2017 Schwartz ..... A63B 6/02
D800,395 S * 10/2017 Olley ..... A63B 21/00047 D30/118
D803,958 S * 11/2017 Clark ..... A47C 27/081 D21/687
D855,713 S * 8/2019 Markos ..... A47C 7/383 D21/627
2003/0207738 A1 * 11/2003 Wong ..... A63B 21/00047 482/74
2004/0019971 A1 * 2/2004 Rhodes ..... A61B 5/055 5/632
2004/0132594 A1 * 7/2004 Verna ..... A63B 21/4039 482/140
2006/0040811 A1 * 2/2006 Foster ..... A63B 21/4037 482/142
2008/0058165 A1 * 3/2008 Schletti ..... A63B 6/00 482/23
2008/0214361 A1 * 9/2008 Oster ..... A63B 6/00 482/23
2011/0207587 A1 * 8/2011 De La Rambelje ..... A63B 21/00047 482/140
2013/0324382 A1 * 12/2013 Wilson ..... A61H 7/007 482/142
2015/0031513 A1 * 1/2015 Park ..... A63B 23/0205 482/140
2015/0111709 A1 * 4/2015 Longfellow ..... A63B 21/068 482/140
2015/0367168 A1 * 12/2015 Henniger ..... A63B 23/0222 482/145
2016/0263423 A1 * 9/2016 Ivy ..... A63B 21/4037

* cited by examiner

ABDOMINAL EXERCISE MAT

CROSS-REFERENCE TO RELATED APPLICATION

N/A

BACKGROUND OF THE DISCLOSURE

1. Field of the Disclosure

The disclosure relates in general to manual exercise equipment, and more particularly, to an abdominal exercise mat.

2. Background Art

Abdominal exercises for the foundation for a strong abdomen, often times referred to as a strong core. It is known that sit-ups and the like are a foundational movement for the improvement of abdominal muscles. The exercise is typically performed on an outside surface, such as the ground, or on a weight or exercise bench or board.

While such exercises are rather simple to execute, and have been known for decades upon decades, room for improvement of the exercise remains. One advancement has been the abdominal exercise mat known commercially as the ABMAT®, as well as a corresponding prior art U.S. Pat. No. 5,611,765 issued to Koch, Jr. The entire disclosure of the '765 patent is hereby incorporated by reference in its entirety. The ABMAT® provided an advancement over performing sit-ups on an outside surface. Among other benefits, the device promotes proper form, cushioning for the body, and accommodation for individuals of differing abdominal strength.

Other prior art includes U.S. Pat. App. Pub. No. 2015/0111709 published to Longfellow, the entire specification of which is hereby incorporated by reference in its entirety. Longfellow purports to disclose a void of material, or thru-hole, encompassing a region designed as proximate to the user's coccyx and sacral areas during use.

Notwithstanding the advancements, there remains a need for improved devices which can overcome deficiencies and which can promote proper form, comfort enhancing and injury preventing improvements.

SUMMARY OF THE DISCLOSURE

The disclosure is directed to an abdominal exercise mat comprising an upper portion and a leg portion. The upper portion has a base surface positionable on an outside surface and an upper surface opposite the base surface. The upper surface has an outwardly concave configuration defined by an upwardly inclined upper end section extending away from a top end thereof, and an upwardly inclined lower end section extending away from a bottom end thereof. The leg portion extends away from the bottom end of the upper portion. The leg portion includes a first side leg and a second side leg. The first side leg has a proximal end at the bottom end and a distal end spaced apart therefrom. The second side leg has a proximal end at the bottom end and a distal end spaced apart therefrom. The first and second side legs define a channel therebetween. The distal ends of each of the first side leg and the second side leg are configured to move independently of each other.

In some configurations, the first side leg includes a base surface that is coplanar with the base surface of the upper portion.

In some configurations, the first side leg includes an upper surface that is substantially parallel to the base surface.

In some configurations, the first side leg includes an inside wall and the second side leg includes an inside wall. The inside wall of the first side leg and the inside wall of the second side leg are spaced apart from each other to define the channel therebetween.

In some configurations, the inside wall of the first and second side legs are substantially parallel to each other so as to be substantially uniformly spaced apart.

In some configurations, the first and second side legs have a length that is approximately between 6 and 15 inches.

In some configurations, the lower end section of the upper portion includes a slot that corresponds to the channel, to extend the channel into the upper portion.

In some configurations, the first inside wall and the second inside wall are oblique to each other so that the channel defined thereby is relatively narrower at the base surface of the first and second side legs and relatively wider at the upper surface of the first and second side legs.

In some configurations, the first inside wall and the second inside wall each comprises substantially planar surfaces that are oblique to the base surface of a respective one of the base surface of the first side leg and the second side leg.

In some configurations, the upper portion has a length of approximately between 18 and 25 inches. The leg portion has a length of approximately between 6 and 15 inches.

In some configurations, a largest thickness of the upper portion is approximately between 2 and 4 inches. A thickness of the leg portion is approximately between 0.75 and 2.25 inches. The largest thickness of the upper portion being greater than the thickness of the leg portion.

In some configurations, the first side leg and the second side leg are substantially identical. The abdominal exercise mat is substantially symmetrical about a longitudinal axis extending through the channel positioned between the first side leg and the second side leg.

In some configurations, the upper portion has a substantially uniform cross-sectional configuration between a first side region and a second side region.

In some configurations, the first side leg has a substantially uniform cross-sectional configuration.

In some configurations, the second side leg has a substantially uniform cross-sectional configuration.

In some configurations, the upper portion includes a central section positioned between the upper end section and the lower end section. The central section is substantially parallel to the base surface.

In some configurations, the first leg portion and the second leg portion each include a base surface that is coplanar with the base surface of the upper portion, and an upper surface that is parallel to the base surface.

In some configurations, the first side leg has an inside wall and the second side leg has an inside wall. The inside wall of the first side leg is substantially parallel to the inside wall of the second side leg, to, in turn, define the channel therebetween.

In some configurations, the upper portion has a first side wall and a second side wall. The first side leg has an outside wall that is coplanar with the first side wall of the upper portion. The second side leg has an outside wall that is coplanar with the second side wall of the upper portion.

BRIEF DESCRIPTION OF THE DRAWINGS

The disclosure will now be described with reference to the drawings wherein.

DETAILED DESCRIPTION OF THE DISCLOSURE

Figure 1:
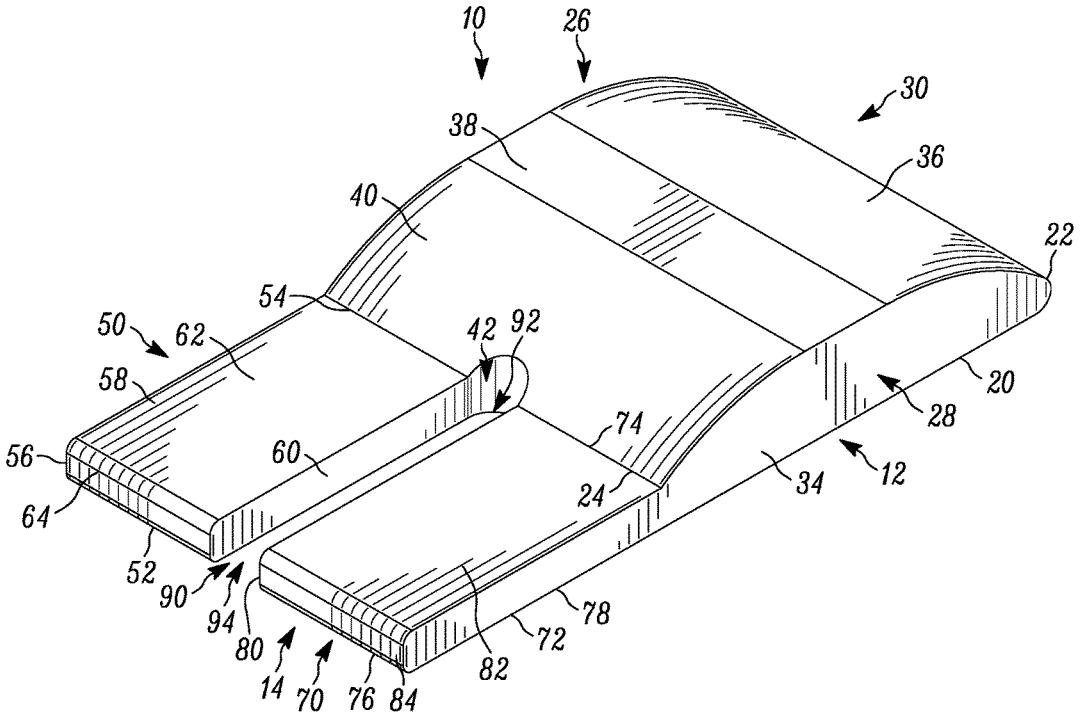
FIG. 1 of the drawings is a top perspective view of the abdominal exercise mat of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
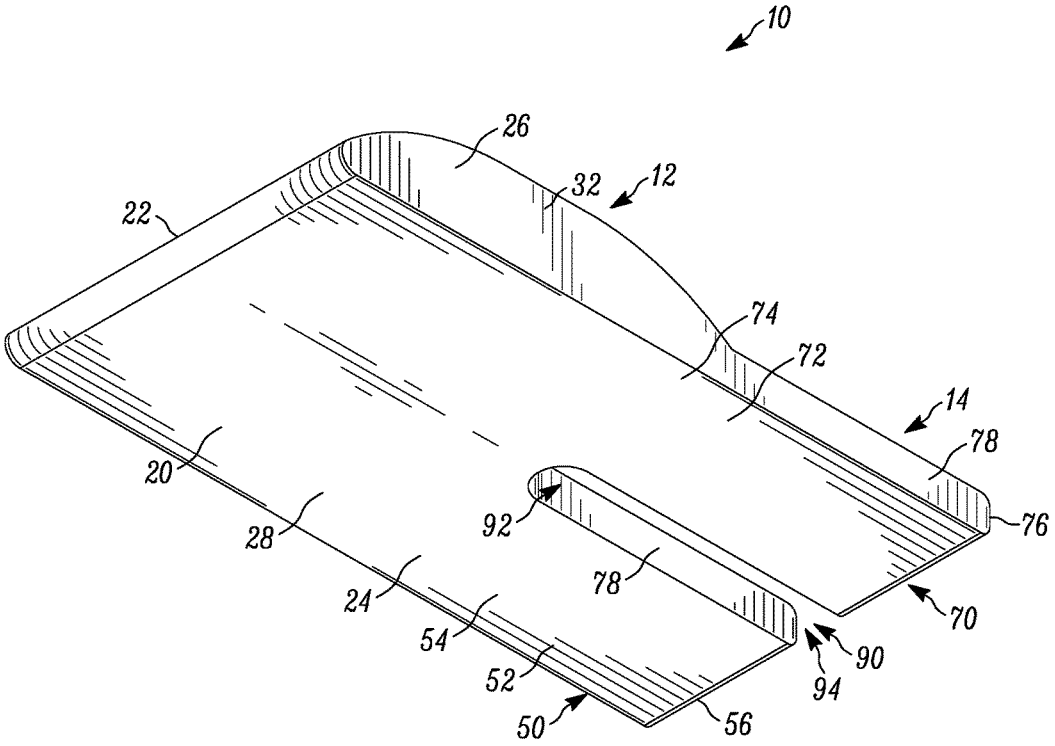
FIG. 2 of the drawings is a bottom perspective view of the abdominal exercise mat of the present disclosure.
Figure 3:
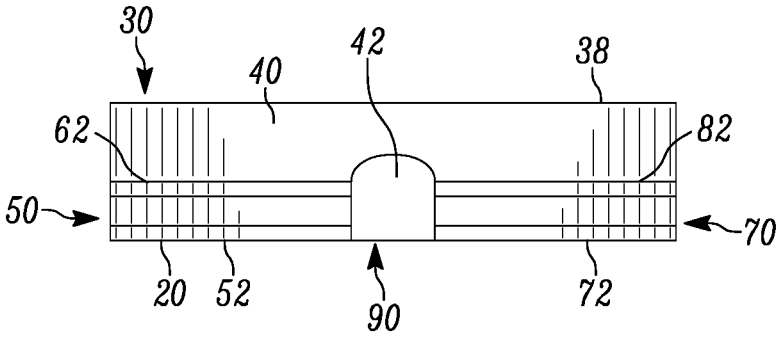
FIG. 3 of the drawings is a rear elevational view of the abdominal exercise mat of the present disclosure.
Figure 4:
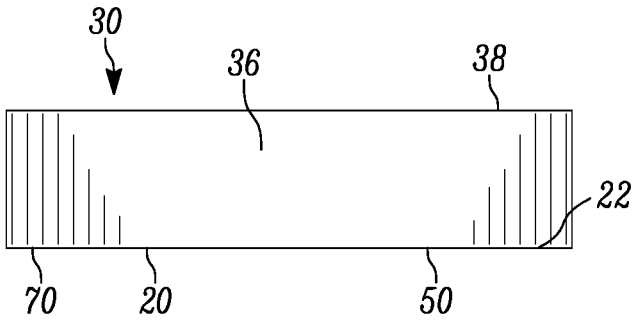
FIG. 4 of the drawings is a front elevational view of the abdominal exercise mat of the present disclosure.

Referring now to the drawings and in particular to FIGS. 1 and 2, the abdominal exercise mat is shown generally at 10. The abdominal exercise mat is configured to allow the user to be positioned thereon, so as to both retain the mat and to do exercises on the mat while retaining the mat by the body of the user. Additionally, the mat is configured to minimize any torque or rotation that may be caused by uneven application of force by muscles in either side of the lower body. Further explanation will be provided below with respect to the operation of the mat.

The abdominal exercise mat 10 includes upper portion 12 and lower leg portion 14. It will be understood that the upper portion and the lower portion may be integrally formed from a single piece of material, such as a foam material or the like. In other configurations, multiple materials may be coupled together through various means, such as adhesive, stitching, heat sealing, and the like. The foam may be self-skinning or a closed cell foam material. in other configurations, the underlying material may be covered with a stitched cover, such as a cover made from a neoprene, a fabric or a natural leather or simulated leather material. In still other configurations, the construction may be a combination of any of the foregoing.

The upper portion 12 of the abdominal exercise mat 10 is defined by a plurality of surfaces, regions and ends. The upper portion 12 includes base surface 20, upper surface 30 and first and second side regions 26, 28 on opposing sides thereof. The upper portion has a top end 22 and a bottom end 24. In the configuration shown, the base surface is substantially planar, with the first and second side regions defining, respectively, a first side wall 32 and a second side wall 34. The first and second side walls are substantially parallel to each other and spaced apart from each other, and, substantially perpendicular to the bottom wall. It will be understood that in other configurations, the first and second sidewalls may be angled toward each other or otherwise arcuate or tapered into the upper surface. It will also be understood that the side walls may meld into the upper surface, or may be rounded so as to meld into the upper and base surfaces.

Figure 5:
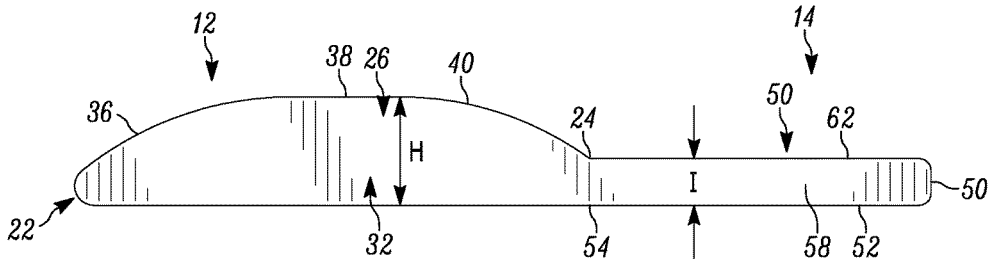
FIG. 5 of the drawings is a first side elevational view of the abdominal exercise mat of the present disclosure.
Figure 6:
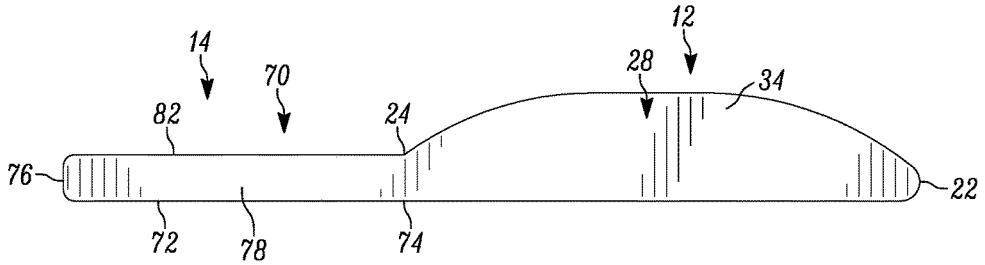
FIG. 6 of the drawings is a second side elevational view of the abdominal exercise mat of the present disclosure.

With additional reference to FIGS. 5 and 6, the upper surface has an upwardly convex configuration between the top end and the bottom end (and can be convex, depending on the configuration side to side). In the configuration shown, the upper surface has a substantially uniform configuration between the first side region 26 and the second side region 28, while variations are contemplated (and notwithstanding the slot 42, described below).

The upper surface includes an upper end section 36, a central section 38 and a lower end section 40. The central section 38 generally comprises a portion that is substantially parallel to the base surface, with each of the upper end section 36 and the lower end section 40 being inclined relative thereto. In the configuration shown, each of the upper end section 36 and the lower end section 40 are substantially arcuate in configuration, with the central section 38 being an inflection surface that is substantially planar. In the configuration shown, the upper end section 36 and the lower end section 40 may have similar radii of curvature. As the lower end section meets the leg portion 14, whereas the upper end portion meets the base surface (or may be rounded proximate thereto), in the configuration shown, the upper end portion has a greater length than the lower leg portion, with the central portion having a length that is less than that of the lower leg portion. Of course, variations may be presented wherein the central section may be enlarged in length or reduced and wherein the central section may be centered between the top end and the bottom end, or wherein the central section may be closer to one of the bottom end and the top end. In other configurations, it is contemplated that the central section may be reduced substantially to an inflection point between the upper end section and the lower end section, so that almost a continuous curve is formed by the upper portion.

Generally, the uniform configuration between the first side region and the second side region precludes a user from rotating off one side of the upper portion while exercising. It will be understood, however, that in some configurations, the upper surface may have a curvature between the first side region and the second side region. Preferably, the cross-sectional configuration is substantially uniform (with the understanding that the slot is positioned within the lower end section).

In the configuration shown, the lower end section 40 includes a slot 42 that is defined proximate the bottom end. In the configuration shown, the slot 42 comprises a semi-circular configuration (as visible from the top) that is equidistantly spaced from the opposing first side region 26 and the second side region 28. In other configurations, this slot may have a configuration that is other than semicircular, such as, square, rectangular, elliptical, polygonal, or otherwise. It will be understood that this slot extends completely through between the base surface and the upper surface. In other configurations, the slot may extend only partially inwardly from the upper surface 30 so that the base surface 30 remains below the slot 42.

With reference to FIGS. 1 through 6, The leg portion 14 is shown as extending from the upper portion 12 at the bottom end 24 thereof. The leg portion 14 includes two separate side legs that extend away from the bottom end 24, namely first side leg 50 and second side leg 70. It will be understood that the side legs are substantially mirror images of each other, in the configuration shown, about a line bisecting the abdominal exercise mat between the side regions. As such, the first side leg will be discussed below with the understanding that the second side leg is substantially identical thereto. Where reference numbers are made to the second side leg, the same reference numbers will be utilized augmented by 20 (i.e., element 50 in first side leg is element 70 in the second side leg).

The first side leg 50 includes base surface 52, outside wall region, which defines outside wall 58, inside wall region, which defines inside wall 60, upper surface 62 and distal end wall 64. The first side leg has proximal end 54 and distal end 56, with the distal end wall 62 defining the distal end 56. In the configuration shown, the base surface 52 is substantially co-planar with the base surface 20, while variations are contemplated wherein the base surface 52 is oblique to the plane defined by base surface 20.

In the configuration shown, the upper surface 64 corresponds to the base surface 52 and is substantially parallel thereto, so as to define a substantially uniform thickness of the first side leg 50, which in turn has a substantially uniform height of each of the outside wall 58, inside wall 60 and distal end wall 64. In the configuration shown, the first side leg 50 comprises a substantially rectangular cubic configuration with the length thereof being elongated relative to the width thereof.

Figure 8:
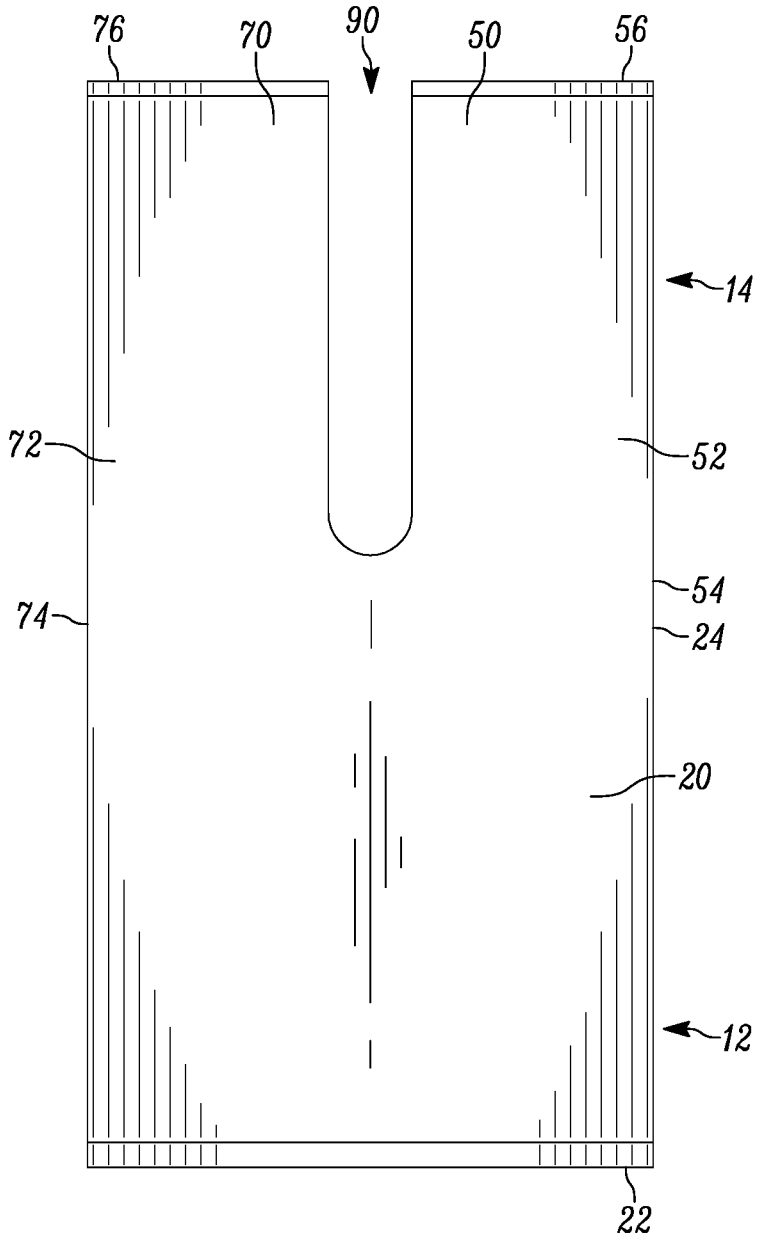
FIG. 8 of the drawings is a bottom plan view of the abdominal exercise mat of the present disclosure.

The second side leg 70 includes base surface 72, outside wall region, which defines outside wall 78, inside wall region, which defines inside wall 80, upper surface 82 and distal end wall 84. The second side leg has proximal end 74 and distal end 76, with the distal end wall 82 defining the distal end 76. In the configuration shown, and with additional reference to FIGS. 5, 6 and 8, the base surface 72 is substantially co-planar with the base surface 20, while variations are contemplated wherein the base surface 72 is oblique to the plane defined by base surface 20.

In the configuration shown, the upper surface 84 corresponds to the base surface 72 and is substantially parallel thereto, so as to define a substantially uniform thickness of the second side leg 70, which in turn has a substantially uniform height of each of the outside wall 78, inside wall 80 and distal end wall 84. In the configuration shown, the second side leg 70 comprises a substantially rectangular cubic configuration with the length thereof being elongated relative to the width thereof.

It is contemplated that the shape of the first side leg 50 and the second side leg 70 may vary from a rectangular cubic. That is, the base surface and the top surface may have different shapes. For example, the upper surface may be smaller than the lower surface so that any one or more of the distal end wall, the outside wall and the inside wall may be inclined or oblique to each of the base surface and the upper surface. In another configuration, the thickness of the first side leg can be varied along the length thereof, so, that, for example, the upper surface is oblique to the base surface 52, 72 which may be coplanar with the base surface 20. In still other configurations, the upper surface and the base surface may have completely different shapes and topographies.

It is likewise contemplated that the first and second side legs may have different shapes relative to each other, while, in the configuration shown, the shapes are substantially uniform and substantially mirror images of each other. It will be understood that generally the upper portion has a length greater than the length of the leg portion, while substantially maintaining the same width (while variations are contemplated).

In the configuration shown, the spacing between the first side leg and the second side leg define a channel 90 therebetween. The channel 90 extends from proximal end 92 to distal end 94, and separates the first side leg from the second side leg with the inside walls 60, 80 facing each other. The channel 90 at proximal end 92 corresponds to the slot 42 defined in the lower end section 40. The configuration of the slot 42 and the dimensions (i.e., width, among others) matches the channel 90 so as to be substantially continuous, in the configuration shown.

Figure 9:
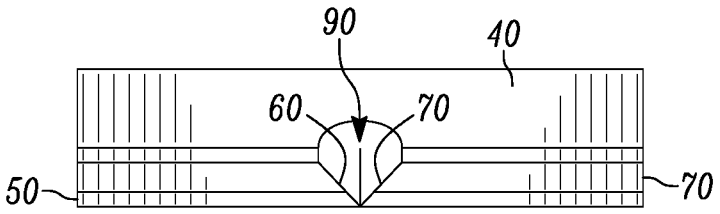
FIG. 9 of the drawings is a top plan view of another configuration of the abdominal exercise mat of the present disclosure, showing, in particular, more closely spaced side legs, with inclined inside walls.
Figure 10:
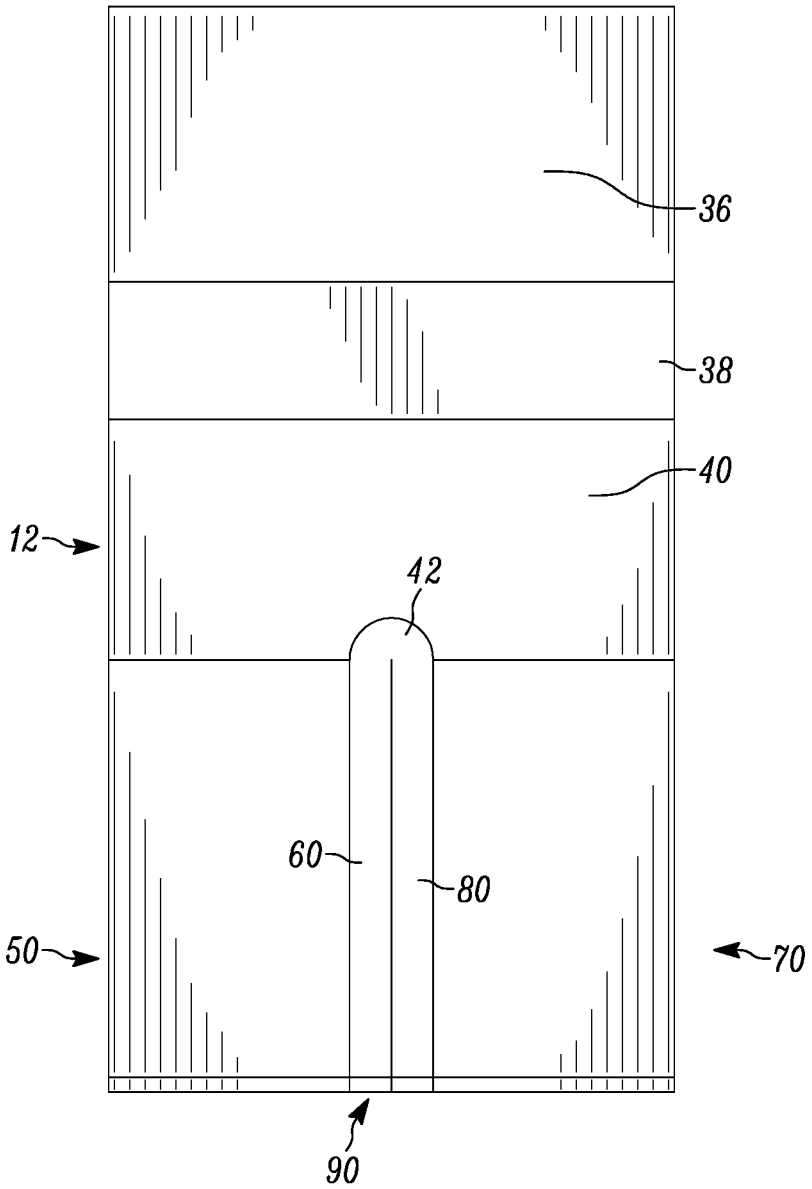
FIG. 10 of the drawings is a rear elevational view of the abdominal exercise mat of the present disclosure.

In the configuration shown, the channel separates the first side leg and the second side leg a predetermined distance. It will be understood that this distance may be varied from a relatively small distance, wherein the first side leg and the second side leg may be close to abutting, or may be abutting, to a greater distance, such as that which is shown. It will further be understood that the inside walls may be oblique such that the channel is smaller proximate the base surfaces 52, 72 and larger at the upper surfaces 62, 82 (so as to define a channel that resembles, for example, an inverted triangular configuration, or an upwardly opening configuration whose cross-section may be defined by a quadratic equation, or the like). One such configuration is shown in FIGS. 9 and 10. It is further contemplated that while the channel is substantially uniform, the inside walls 60, 80 may be varied so as to provide additional void regions, or additional volume to the channel.

Figure 7:
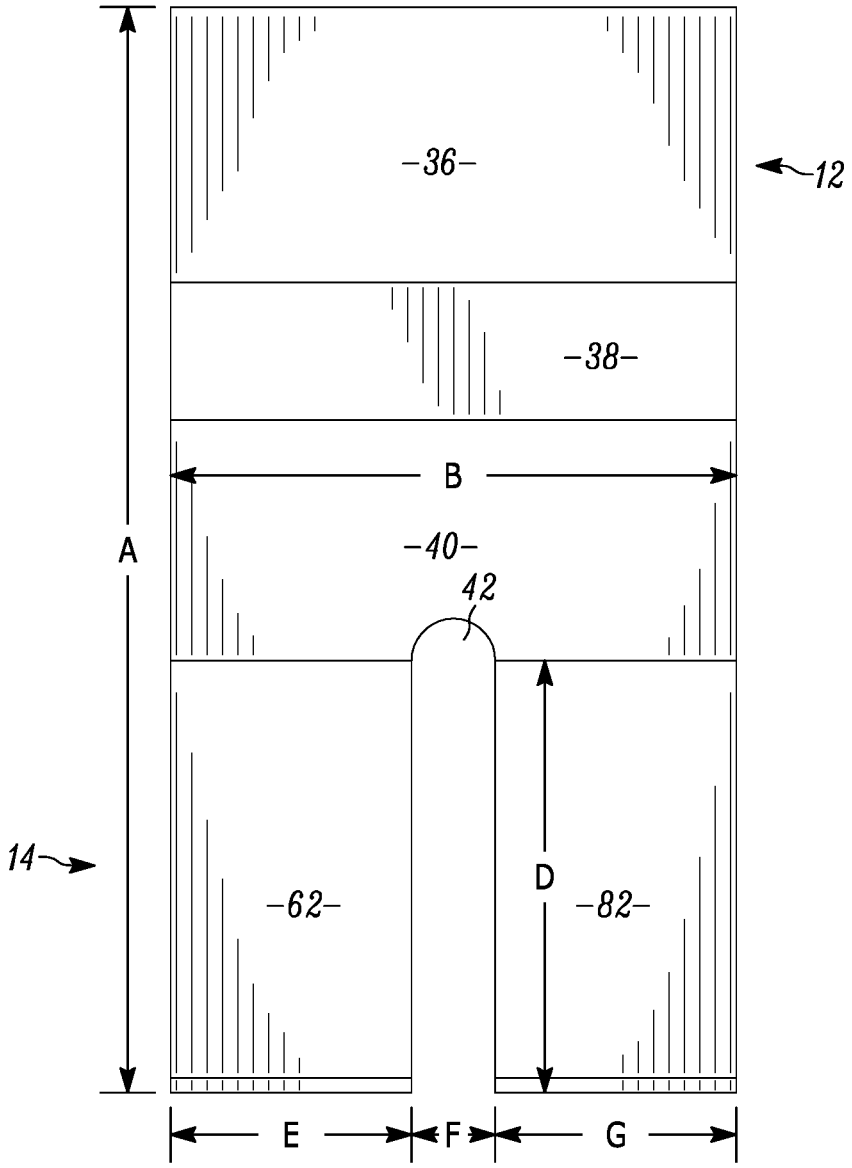
FIG. 7 of the drawings is a top plan view of the abdominal exercise mat of the present disclosure.

With reference to FIGS. 5 and 7, in the configuration shown, the overall length of the abdominal exercise mat, denoted by dimension A, is approximately 22.5 inches (and ranges between approximately 18 and 25 inches, preferably). The overall width, denoted by the dimension B is approximately 11.75 inches (and ranges between approximately 8 and 15 inches, preferably). The length of the channel along with the slot of the lower end section, denoted by the dimension C is approximately 10 inches (and ranges between approximately 7 and 15 inches, preferably). The length of the first and second side legs, denoted by the dimension D is approximately 9 inches (and ranges between approximately 6 and 15 inches, preferably). The width of the first leg and second leg, denoted by the dimensions E and G, respectively, is approximately 5 inches (and ranges between approximately 3 and 7 inches, preferably). The width of the channel between the first leg and the second leg, denoted by the dimension F, is approximately 1.75 inches (and ranges between a first dimension wherein the base surfaces are substantially adjacent to approximately 3 inches, preferably). The height of the upper portion between the base surface and the central section, denoted by the dimension H, is approximately 2.75 inches (and ranges between approximately 2 and 4 inches, preferably). The thickness of the leg portion, denoted by the dimension I, is approximately 1.25 inches (and ranges between approximately 0.75 and 2.25 inches, preferably). It will be understood that the dimension H is greater than the dimension I, with those dimensions identifying generally the largest such dimension (i.e., the structures may be other than uniform in thickness).

Of course, it is contemplated that the dimensions may be varied without departing from the scope of the disclosure. For example, the length or width of each of the upper portion and the leg portion can be larger or smaller. The channel may be wider or narrower, with the understanding, that the channel needs to separate the first side leg from the second side leg, while providing room for the coccyx (tailbone) to extend therebetween. Where the channel is narrower, it may be desirable to incline the inside walls so as to create a larger channel proximate the upper surface.

In operation, the abdominal mat is provided and placed on a suitable outside surface. Typically, such outside surface comprises a floor, such as a workout floor, a building floor, an outside surface or the like. Of course, such an outside surface may be elevated, such as a workout bench or the like. Once positioned, a user sits on the abdominal exercise mat. In one configuration, the user sits on the leg portion, placing the opposing sides of the buttock on the first and second side legs of the leg portion, respectively, while facing away from the upper portion. As the user directs herself backwards, the back of the user eventually contacts the upper surface 30 of the upper portion 12. Generally, this occurs sequentially, first contacting the lower end section, then the central section and finally the upper end section. Depending on the form of the user, the different sections can be contacted in an alternate sequence, or not at all in some instances, wherein the user contacts only one or two of the sections.

At the same time that the user is inclining backwards, the coccyx is generally positioned to overlie the channel defined between the first side leg and the second side leg. By maintaining the coccyx between the first side leg and the second side leg, the user can minimize injury thereto. In addition, by having the channel formed in cooperation with the separate side legs, the coccyx remains protected, while the abdominal exercise mat absorbs the differential loads through the substantially independent relative movement of the separate side legs.

In greater detail, it will further be understood that when the user is undertaking sis-ups, due to muscle imbalances and the differing strength between the opposite sides of the body, the user may twist or torque to one side or the other. This rotational movement is then imparted to the abdominal exercise mat, typically through the buttocks. Due to the independent movement capability of the first side leg relative to the second side leg, the mat is configured to minimize any torque or rotation that may be caused by this uneven application of force by muscles in either side of the lower body. That is, the two leg portions can move independently so as to reduce the amount of force that is directed to the upper portion, and to dissipate the relative movement differences between the first side leg and the second side leg. In turn, as the user continues the exercise, undesirable movement of the upper portion relative to the body of the user can be minimized. The advantages of this feature become visible as the speed of the exercise increases, and the forces/change of direction becomes greater and with increased force.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. An abdominal exercise mat comprising:

an upper portion, of the abdominal exercise mat, having a base surface positionable on an outside surface and an upper surface opposite the base surface, the upper surface being configured to contact a back of a user during use and having an outwardly concave configuration defined by an upwardly inclined upper end section extending away from a top end thereof, and an upwardly inclined lower end section extending away from a bottom end thereof; and a leg portion, of the abdominal exercise mat, extending away from the bottom end of the upper portion, the leg portion including a first side leg and a second side leg, the first side leg having a proximal end at the bottom end and a distal end spaced apart therefrom, and the second side leg having a proximal end at the bottom end and a distal end spaced apart therefrom, the first and second side legs defining a channel therebetween, wherein the distal ends of each of the first side leg and the second side leg are configured to move independently of each other, and wherein, in use, the first side leg and second side leg of the leg portion are configured to support buttocks of the user.

2. The abdominal exercise mat of claim 1 the first side leg includes a base surface that is coplanar with the base surface of the upper portion.

3. The abdominal exercise mat of claim 2 wherein the first side leg includes an upper surface that is substantially parallel to the base surface.

4. The abdominal exercise mat of claim 2 wherein the first side leg includes an inside wall and the second side leg includes an inside wall, with the inside wall of the first side leg and the inside wall of the second side leg are spaced apart from each other to define the channel therebetween.

5. The abdominal exercise mat of claim 4 wherein the inside wall of the first and second side legs are substantially parallel to each other so as to be substantially uniformly spaced apart.

6. The abdominal exercise mat of claim 5 wherein the first and second side legs have a length that is approximately between 6 and 15 inches, with an overall length of the abdominal exercise mat being between 18 and 15 inches.

7. The abdominal exercise mat of claim 1 wherein the lower end section of the upper portion includes a slot that corresponds to the channel, the slot extending completely through between the base surface and the upper surface.

8. The abdominal exercise mat of claim 4 wherein the first inside wall and the second inside wall are oblique to each other so that the channel defined thereby is relatively narrower at the base surface of the first and second side legs and relatively wider at the upper surface of the first and second side legs.

9. The abdominal exercise mat of claim 8 wherein the first inside wall and the second inside wall each comprises substantially planar surfaces that are oblique to the base surface of a respective one of the base surface of the first side leg and the second side leg.

10. The abdominal exercise mat of claim 1 wherein the upper portion has a length of approximately between 18 and 25 inches, and the leg portion has a length of approximately between 6 and 15 inches.

11. The abdominal exercise mat of claim 10 wherein a largest thickness of the upper portion is approximately between 2 and 4 inches, with a thickness of the leg portion is approximately between 0.75 and 2.25 inches, with the largest thickness of the upper portion being greater than the thickness of the leg portion.

12. The abdominal exercise mat of claim 1 wherein the first side leg and the second side leg are substantially identical, with the abdominal exercise mat being substantially symmetrical about a longitudinal axis extending through the channel positioned between the first side leg and the second side leg.

13. The abdominal exercise mat of claim 1 wherein the upper portion has a substantially uniform cross-sectional configuration between a first side region and a second side region.

14. The abdominal exercise mat of claim 13 wherein the first side leg has a substantially uniform cross-sectional configuration.

15. The abdominal exercise mat of claim 14 wherein the second side leg has a substantially uniform cross-sectional configuration.

16. The abdominal exercise mat of claim 15 wherein the upper portion includes a central section positioned between the upper end section and the lower end section, the central section being substantially parallel to the base surface.

17. The abdominal exercise mat of claim 16 wherein the first leg portion and the second leg portion each include a base surface that is coplanar with the base surface of the upper portion, and an upper surface that is parallel to the base surface.

18. The abdominal exercise mat of claim 17 wherein the first side leg has an inside wall and the second side leg has an inside wall, with the inside wall of the first side leg being substantially parallel to the inside wall of the second side leg, to, in turn, define the channel therebetween.

19. The abdominal exercise mat of claim 18 wherein the upper portion has a first side wall and a second side wall, and wherein the first side leg has an outside wall that is coplanar with the first side wall of the upper portion, and wherein the second side leg has an outside wall that is coplanar with the second side wall of the upper portion.

20. The abdominal exercise mat of claim 1 wherein a largest thickness of the upper portion is at least twice that of a largest thickness of the leg portion.

21. The abdominal exercise mat of claim 7 wherein the slot has a width that substantially matches a width of the channel so as to be substantially continuous.

* * * * *